US006010103A

United States Patent [19]

Ashworth

[11] Patent Number: 6,010,103

[45] Date of Patent: Jan. 4, 2000

[54] HOOK FOR AIR GUNS AND AIR NAILERS

[76] Inventor: James Ashworth, Rte. 2 Box 296-B, Moneta, Va. 24121

[21] Appl. No.: 08/954,582

[22] Filed: Oct. 20, 1997

[51] Int. Cl.[7] ..... A47F 5/00

[52] U.S. Cl. ..... 248/301; 173/171; D8/349

[58] Field of Search ..... 248/301, 339; D8/349, 355, 366; 173/171, 162.1, DIG. 2

[56] References Cited

U.S. PATENT DOCUMENTS

| | | | |
|---|---|---|---|
| D. 223,082 | 3/1972 | Fromm | D8/233 |
| D. 236,251 | 8/1975 | Cunningham | D3/230 |
| D. 244,830 | 6/1977 | Tulak | D8/402 |
| D. 331,529 | 12/1992 | Reinklou | D8/73 |
| D. 376,388 | 12/1996 | Hall | D20/43 |
| 2,551,769 | 5/1951 | Sieben | 121/36 |
| 3,055,625 | 9/1962 | Kopf et al. | 248/339 |
| 3,136,841 | 6/1964 | Stiner | 174/40 |
| 3,360,075 | 12/1967 | Gutner | 182/106 |
| 3,780,950 | 12/1973 | Brennan | 239/306 |
| 4,447,030 | 5/1984 | Nattel | 248/27.1 |
| 5,180,019 | 1/1993 | Thiry et al. | 173/168 |
| 5,509,632 | 4/1996 | Mesna et al. | 248/301 |
| 5,626,244 | 5/1997 | Mesna et al. | 211/60.1 |

*Primary Examiner*—Derek J. Berger
*Assistant Examiner*—Kimberly Wood

[57] ABSTRACT

A new hook for air guns and air nailers for enabling air guns and air nailers to be safely hung at an elevated position. The inventive device includes an L-shaped hook portion having a vertically oriented portion and a horizontally oriented portion joined together at a bend. The horizontally oriented portion has an aperture therethrough disposed inwardly of a free end thereof. The aperture is dimensioned for fitting over a pneumatic air fitting and threading an air hose therethrough.

1 Claim, 2 Drawing Sheets

HOOK FOR AIR GUNS AND AIR NAILERS

BACKGROUND OF THE INVENTION

1. Field of the Invention

The present invention relates to hooks and more particularly pertains to a new hook for air guns and air nailers for enabling air guns and air nailers to be safely hung at an elevated position.

2. Description of the Prior Art

The use of hooks is known in the prior art. More specifically, hooks heretofore devised and utilized are known to consist basically of familiar, expected and obvious structural configurations, notwithstanding the myriad of designs encompassed by the crowded prior art which have been developed for the fulfillment of countless objectives and requirements.

Known prior art hooks include U.S. Pat. No. 5,329,728 to Ray; U.S. Pat. No. 5,385,320 to Ismert et al.; U.S. Pat. No. Des. 289,733 to Kasai; U.S. Pat. No. 4,908,982 to Quatrini; U.S. Pat. No. 4,895,336 to Lieberman; and U.S. Pat. No. 4,676,465 to Myotte.

While these devices fulfill their respective, particular objectives and requirements, the aforementioned patents do not disclose a new hook for air guns and air nailers. The inventive device includes an L-shaped hook portion having a vertically oriented portion and a horizontally oriented portion joined together at a bend. The horizontally oriented portion has an aperture therethrough disposed inwardly of a free end thereof. The aperture is dimensioned for fitting over a pneumatic air fitting and threading an air hose therethrough.

In these respects, the hook for air guns and air nailers according to the present invention substantially departs from the conventional concepts and designs of the prior art, and in so doing provides an apparatus primarily developed for the purpose of enabling air guns and air nailers to be safely hung at an elevated position.

SUMMARY OF THE INVENTION

In view of the foregoing disadvantages inherent in the known types of hooks now present in the prior art, the present invention provides a new hook for air guns and air nailers construction wherein the same can be utilized for enabling air guns and air nailers to be safely hung at an elevated position.

The general purpose of the present invention, which will be described subsequently in greater detail, is to provide a new hook for air guns and air nailers apparatus and method which has many of the advantages of the hooks mentioned heretofore and many novel features that result in a new hook for air guns and air nailers which is not anticipated, rendered obvious, suggested, or even implied by any of the prior art hooks, either alone or in any combination thereof.

To attain this, the present invention generally comprises an L-shaped hook portion having a vertically oriented portion and a horizontally oriented portion joined together at a bend. The vertically oriented portion has a length slightly less than a length of the horizontally oriented portion. The horizontally oriented portion has an aperture therethrough disposed inwardly of a free end thereof. The aperture is dimensioned for fitting over a pneumatic air fitting and threading an air hose therethrough.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hook for air guns and air nailers apparatus and method which has many of the advantages of the hooks mentioned heretofore and many novel features that result in a new hook for air guns and air nailers which is not anticipated, rendered obvious, suggested, or even implied by any of the prior art hooks, either alone or in any combination thereof.

It is another object of the present invention to provide a new hook for air guns and air nailers which may be easily and efficiently manufactured and marketed.

It is a further object of the present invention to provide a new hook for air guns and air nailers which is of a durable and reliable construction.

An even further object of the present invention is to provide a new hook for air guns and air nailers which is susceptible of a low cost of manufacture with regard to both materials and labor, and which accordingly is then susceptible of low prices of sale to the consuming public, thereby making such hook for air guns and air nailers economically available to the buying public.

Still yet another object of the present invention is to provide a new hook for air guns and air nailers which provides in the apparatuses and methods of the prior art some of the advantages thereof, while simultaneously overcoming some of the disadvantages normally associated therewith.

Still another object of the present invention is to provide a new hook for air guns and air nailers for enabling air guns and air nailers to be safely hung at an elevated position.

Yet another object of the present invention is to provide a new hook for air guns and air nailers which includes an L-shaped hook portion having a vertically oriented portion and a horizontally oriented portion joined together at a bend.

The horizontally oriented portion has an aperture therethrough disposed inwardly of a free end thereof. The aperture is dimensioned for fitting over a pneumatic air fitting and threading an air hose therethrough.

Still yet another object of the present invention is to provide a new hook for air guns and air nailers that will keep an air gun or nailer at an accessible location.

Even still another object of the present invention is to provide a new hook for air guns and air nailers that would limit the damages that would occur.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
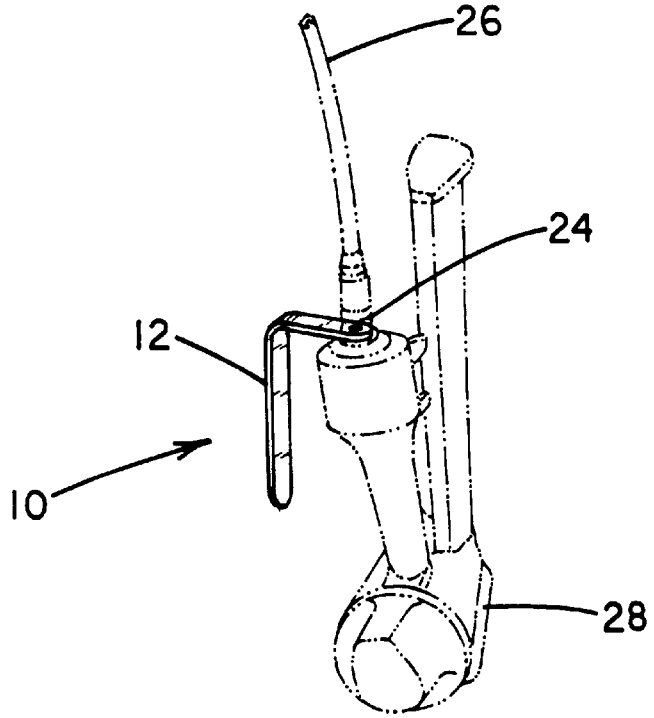
FIG. 1 is a perspective view of a new hook for air guns and air nailers according to the present invention.
Figure 2:
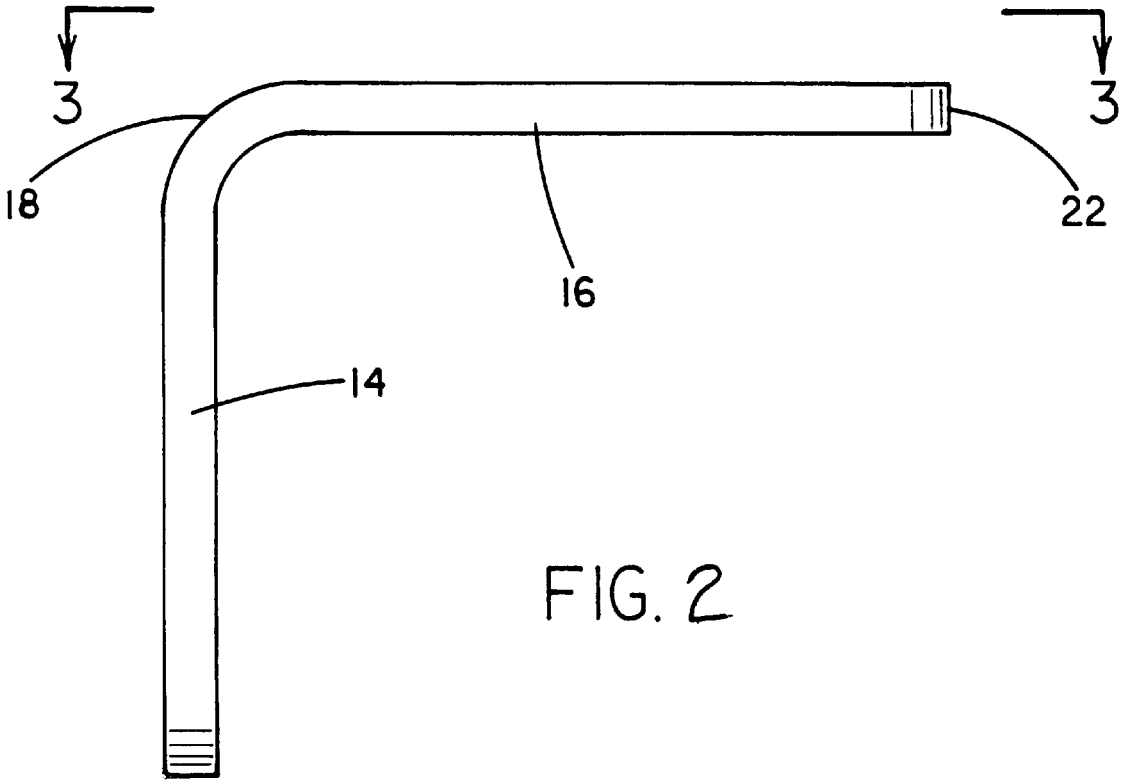
FIG. 2 is a side elevation view of the present invention.
Figure 3:
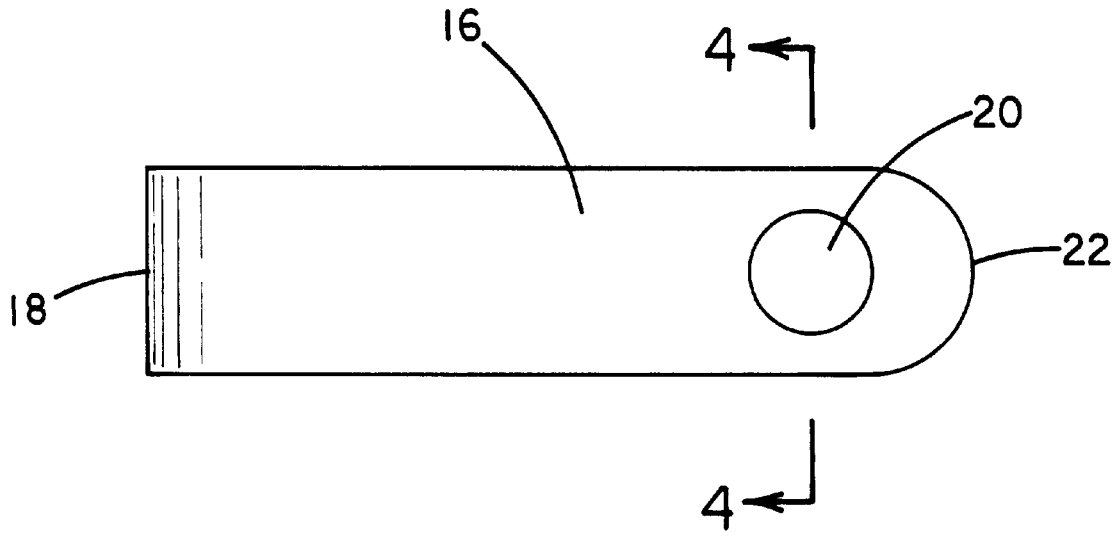
FIG. 3 is a top plan view of the present invention as taken along line 3—3 of FIG. 2.
Figure 4:
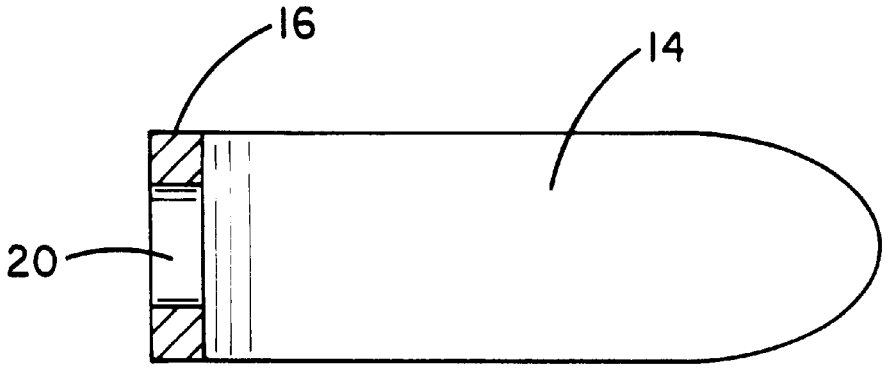
FIG. 4 is a cross-sectional view of the present invention as taken along line 4—4 of FIG. 3.

With reference now to the drawings, and in particular to FIGS. 1 through 4 thereof, a new hook for air guns and air nailers embodying the principles and concepts of the present invention and generally designated by the reference numeral 10 will be described.

As best illustrated in FIGS. 1 through 4, the hook for air guns and air nailers 10 comprises a simple hook for a pneumatic tool, which would enable the tool to be safely hung on a ladder, a rafter, or even the user's belt. The present invention comprises an L-shaped hook portion 12 having a vertically oriented portion 14 and a horizontally oriented portion 16 joined together at a bend 18. The vertically oriented portion 14 has a length slightly less than a length of the horizontally oriented portion 16. The horizontally oriented portion 16 has an aperture 20 therethrough disposed inwardly of a free end 22 thereof. The aperture 20 is dimensioned for fitting over a pneumatic air fitting 24 and threading an air hose 26 therethrough.

In use, the aperture 20 would enable the user to easily install the present invention on a pneumatic gun, nailer, or similar tool. The user would simply remove the top of the air fitting 24 of the tool 28, pass the base of the nipple for the fitting 24 through the aperture 20 in the present invention, and then replace the fitting 24. This would secure the present invention to the tool 28, and enable it to be used as a hook for hanging the tool 28 in various locations. The present invention could be easily adapted to fit different makes and types of tools, by simply positioning the aperture 20 closer or further from the free end 22 of the horizontally oriented portion 16, depending on the exact design of the tool 28 on which it is to be used. The vertically oriented portion 14 of the L-shaped hook portion 12 is slipped either between rungs of a ladder or into a tool belt for support of the present invention.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new hook system comprising:

an air tool including a handle having an air fitting with a base removably mounted on a bottom of the handle, wherein the air fitting has a nipple; and an L-shaped hook portion having a vertically oriented portion and a horizontally oriented portion joined together at first ends thereof at a bend, the vertically oriented portion having a length approximately ⅞ a length of the horizontally oriented portion, the horizontally oriented portion having an aperture therethrough disposed inwardly of a free second end thereof, the aperture being positioned about the base of the air fitting between the nipple and the air tool such that the horizontally oriented portion extends laterally from the bottom of the handle in coplanar relationship therewith and the vertically oriented portion extends in spaced parallel relationship with the handle;

said vertically oriented portion and said horizontally oriented portion each having a common width;

said aperture of the said horizontally oriented portion having a diameter approximately ½ the width of the horizontally oriented portion and the vertically oriented portion;

said aperture of the said horizontally oriented portion being positioned a distance from the second of said horizontally oriented portion approximately equal the diameter of the aperture;

said second end of said horizontally oriented portion having a semicircular configuration;

said second end of said vertically oriented portion having an elliptical configuration;

said horizontally oriented portion having a length approximately eight times the diameter of the aperture.

* * * * *